US009964066B2

(12) United States Patent
Yamamoto et al.

(10) Patent No.: US 9,964,066 B2
(45) Date of Patent: May 8, 2018

(54) INTERNAL COMBUSTION ENGINE

(71) Applicant: TOYOTA JIDOSHA KABUSHIKI KAISHA, Toyota-shi (JP)

(72) Inventors: Yasuhiro Yamamoto, Chiryu (JP); Takehisa Fujita, Nisshin (JP); Naoyuki Miyara, Nagoya (JP); Hajime Takagawa, Susono (JP); Eiichi Hioka, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days. days.

(21) Appl. No.: 15/167,282

(22) Filed: May 27, 2016

(65) Prior Publication Data

US 2016/0348608 A1 Dec. 1, 2016

(30) Foreign Application Priority Data

May 27, 2015 (JP) ..... 2015-107573

(51) Int. Cl.

| | |
|---|---|
| ***F02F 1/10*** | (2006.01) |
| ***F01P 3/14*** | (2006.01) |
| ***F02F 1/40*** | (2006.01) |
| ***F01L 3/12*** | (2006.01) |
| ***F02F 1/42*** | (2006.01) |
| *F01L 3/00* | (2006.01) |

(52) U.S. Cl.

CPC ..... *F02F 1/10* (2013.01); *F01L 3/12* (2013.01); *F01P 3/14* (2013.01); *F02F 1/40* (2013.01); *F02F 1/4285* (2013.01); *F01L 2003/25* (2013.01); *F01L 2103/00* (2013.01); *F01L 2810/01* (2013.01)

(58) Field of Classification Search

CPC ..... F02F 1/10; F01P 3/02; F01L 3/12

See application file for complete search history.

(56) References Cited

U.S. PATENT DOCUMENTS 5,765,520 A 6/1998 Adachi et al.
2004/0031454 A1* 2/2004 Hirano ..... F01L 1/28 123/79 C

FOREIGN PATENT DOCUMENTS

JP 56-71906 U 6/1981
JP 56-154546 U 11/1981
(Continued)

OTHER PUBLICATIONS

Notification of Reason(s) for Refusal dated May 23, 2017 in Japanese Patent Application No. 2015-107573 (submitting partial English language translation only).

*Primary Examiner* — Kevin A Lathers
(74) *Attorney, Agent, or Firm* — Oblon, McClelland, Maier & Neustadt, L.L.P.

(57) ABSTRACT

An internal combustion engine includes a cylinder head including an intake port, an exhaust port, a water jacket, an intake valve, an exhaust valve, an intake valve seat, and an exhaust valve seat. The water jacket is positioned between the intake port and the exhaust port. The intake valve includes an intake valve head, and the exhaust valve includes an exhaust valve head. The intake valve contacts an intake valve seat surface of the intake valve seat. The exhaust valve head contacts an exhaust valve seat surface of the exhaust valve seat. The shortest distance between the water jacket and the intake valve seat surface is shorter than the shortest distance between the water jacket and the exhaust valve seat surface.

7 Claims, 2 Drawing Sheets

(56) References Cited

FOREIGN PATENT DOCUMENTS

| | | | | |
|---|---|---|---|---|
| JP | 60-098747 | U | | 7/1985 |
| JP | 62-150014 | | | 7/1987 |
| JP | 63-136241 | U | | 9/1988 |
| JP | 1-271607 | A | | 10/1989 |
| JP | 05-133225 | A | | 5/1993 |
| JP | 2005-133225 | A | | 5/1993 |
| JP | 07-150912 | A | | 6/1995 |
| JP | 2007-150912 | A | | 6/1995 |
| JP | 9-13919 | A | | 1/1997 |
| JP | 2000240504 | A | * | 9/2000 |
| JP | 2005-299598 | | | 10/2005 |
| JP | 2008-149326 | | | 7/2008 |
| JP | 2008-188648 | A | | 8/2008 |
| JP | 2008-1888648 | A | | 8/2008 |

* cited by examiner

INTERNAL COMBUSTION ENGINE

INCORPORATION BY REFERENCE

The disclosure of Japanese Patent Application No. 2015-107573 filed on May 27, 2015 including the specification, drawings and abstract is incorporated herein by reference in its entirety.

BACKGROUND

1. Field

The disclosure relates to an internal combustion engine having an intake valve and an exhaust valve.

2. Description of Related Art

In a cylinder head of an internal combustion engine, a valve seat, which a head of a valve contacts, is provided in a connecting part in which an intake port is connected with a combustion chamber. Also, in a connecting part in which an exhaust port is connected with the combustion chamber, a valve seat is provided. A head of a valve contacts the valve seat.

As a valve seat provided in a cylinder head as stated above, there is known a seat that is formed by performing cladding on the above-mentioned connecting part of the cylinder head. For example, Japanese Patent Application Publication No. 2008-188648 (JP 2008-188648 A) discloses a valve seat cladded on the connecting part by feeding metal powder in the connecting part of the cylinder head while irradiating the connecting part with a laser beam. This type of valve seat has a high a degree of adhesion to the cylinder head, and heat transfer efficiency to the cylinder head is high. Therefore, it is possible to favorably restrain an increase in temperature of the valve seat and the head of the valve.

In the cylinder head disclosed in JP 2008-188648 A, the intake valve seat and the exhaust valve seat are both formed by cladding.

SUMMARY

Inside a cylinder head, a water jacket is provided between an intake port and an exhaust port. Heat transferred from the valve seat to the cylinder head is recovered by cooling water flowing inside the water jacket. Therefore, when a distance from the intake valve seat to the water jacket is long, it becomes unlikely that cooling water flowing inside the water jacket recovers heat of the intake valve seat and the head of the intake valve.

Since temperature of exhaust gas discharged from the combustion chamber to the exhaust port is high, temperature of the head of the exhaust valve and the exhaust valve seat tends to become higher than that of the head of the intake valve and the intake valve seat. In particular, when the internal combustion engine is operated at high rotation and high-speed load, temperature of the exhaust gas becomes very high. In this case, heat transferred from the exhaust valve seat to the cylinder head is also transferred to a peripheral part of the intake valve seat in the cylinder head. Then, temperature of the peripheral part of the intake valve seat becomes high.

When a distance from the intake valve seat to the water jacket is long, temperature of both of the intake valve seat and the head of the intake valve increases due to heat transferred to the peripheral part of the intake valve seat in the cylinder head from the exhaust valve seat. As a result, temperature of intake air supplied into the combustion engine through the intake port increases. This could reduce a charging efficiency of air sucked into the combustion chamber.

An internal combustion engine is provided, which is able to restrain a reduction in a charging efficiency of intake air into the combustion chamber by restraining an increase in temperature of an intake valve seat and a head of an intake valve.

An internal combustion engine is provided. The internal combustion engine includes a cylinder head including an intake port, an exhaust port, a water jacket, an intake valve, an exhaust valve, an intake valve seat, and an exhaust valve seat. The intake port includes an intake connecting part at which the intake port and the combustion chamber of the internal combustion engine are connected with each other. The exhaust port includes an exhaust connecting part at which the exhaust port and the combustion chamber are connected with each other. The water jacket is positioned between the intake port and the exhaust port. An intake valve is mounted on the intake port, and the intake valve includes an intake valve head. An exhaust valve is mounted on the exhaust port, and the exhaust valve includes an exhaust valve head. The intake valve head is structured so as to abut on the intake connecting part and the intake valve seat. The intake valve head contacts an intake valve seat surface of the intake valve seat. The exhaust valve head is structured so as to abut on the exhaust connecting part and the exhaust valve seat. The exhaust valve head contacts an exhaust valve seat surface of the exhaust valve seat. The shortest distance between the water jacket and the exhaust valve seat surface is regarded as the first distance. The shortest distance between the water jacket and the intake valve seat surface is regarded as the second distance. The second distance is shorter than the first distance.

According to the above structure, cooling the intake valve seat and the head of the intake valve by using cooling water flowing inside the water jacket is more efficient than cooling the exhaust valve seat and the head of the exhaust valve by using cooling water flowing in the water jacket. Therefore, even if heat transferred from the exhaust valve seat to the cylinder head is transferred to a peripheral part of the intake valve seat in the cylinder head, cooling water flowing inside foregoing water jacket is able to efficiently recover heat of the peripheral part of the intake valve seat in the cylinder head. As a result, an increase in temperature of the intake valve seat and the head of the intake valve is restrained. By restraining a temperature increase of the intake valve seat and the head of the intake valve, it becomes possible to restrain a reduction in a charging efficiency of intake air into the combustion chamber.

It is preferred that heat conductivity of the exhaust valve seat is lower than heat conductivity of the intake valve seat. According to this structure, heat transfer efficiency from the exhaust valve seat to the cylinder head is lowered, and, accordingly, cooling efficiency of the intake valve seat and the head of the intake valve is improved. Therefore, it is possible to further improve an effect of restraining a temperature increase of the intake valve seat and the head of the intake valve.

Moreover, it is preferred that heat capacity of the exhaust valve seat is larger than heat capacity of the intake valve seat. When the internal combustion engine is operated at high rotation and high-speed load temporarily, temperature of exhaust gas increases temporarily. At this time, even when temperature of exhaust gas is increased temporarily, it is possible to reduce a heat transfer quantity from the exhaust valve seat to the cylinder head because of the large heat capacity of the exhaust valve seat. In other words, heat received by the exhaust valve seat from exhaust gas is transferred to the cylinder head little by little. As a result, deterioration of heat transfer efficiency from the intake valve seat to the cylinder head caused by a temporary temperature rise of exhaust gas is restrained, thereby restraining a temperature increase of the intake valve seat and the head of the intake valve.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
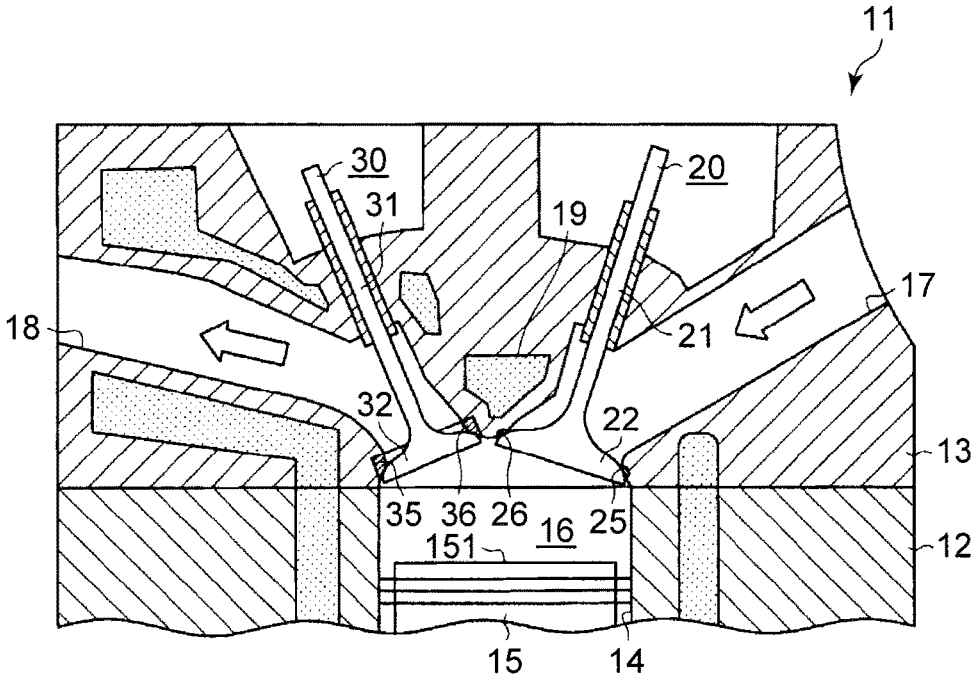
FIG. 1 is a schematic sectional view of a part of an internal combustion engine according to an embodiment.

Herein below, an embodiment of an internal combustion engine is explained based on FIG. 1 and FIG. 2. As shown in FIG. 1, an internal combustion engine 11 of this embodiment includes a cylinder block 12 and a cylinder head 13 assembled to an upper part of the cylinder block 12 in the drawing. Inside the internal combustion engine 11, a plurality of cylinders 14 is formed. In each of the cylinders 14, a piston 15 is provided, moving forward and backward in the vertical direction in the drawing. A combustion chamber 16 is formed between the cylinder head 13 and a top surface 151 of the piston 15. In the combustion chamber 16, an air-fuel mixture containing fuel and intake air is combusted.

In the cylinder head 13, an intake port 17 for introducing intake air into the combustion chamber 16, and an exhaust port 18 for discharging exhaust gas generated in the combustion chamber 16 are provided. Further, inside the cylinder head 13, a water jacket 19, in which cooling water flows, is provided between the intake port 17 and the exhaust port 18.

The internal combustion engine 11 is also provided with an intake valve 20 that opens and closes the intake port 17 with respect to the combustion chamber 16, and an exhaust valve 30 that opens and closes the exhaust port 18 with respect to the combustion chamber 16. The valves 20, 30 have rod-shaped shaft parts 21, 31 and heads 22, 32 provided in distal ends of the shaft parts 21, 31, respectively.

Figure 2:
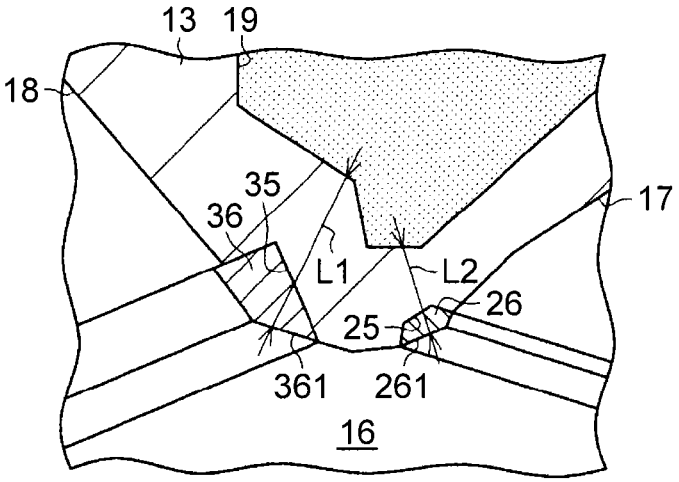
FIG. 2 is an enlarged sectional view of a part of a cylinder head of the internal combustion engine.

As shown in FIG. 1 and FIG. 2, a downstream end of the intake port 17 serves as an intake connecting part 25. In the intake connecting part 25, the intake port 17 and the combustion chamber 16 are connected with each other. Similarly, an upstream end of the exhaust port 18 serves as an exhaust connecting part 35. In the exhaust connecting part 35, the exhaust port 18 and the combustion chamber 16 are connected with each other. In the intake connecting part 25, an intake valve seat 26 is provided, on which the head 22 of the intake valve 20 abuts. In the exhaust connecting part 35, an exhaust valve seat 36 is provided, on which the head 32 of the exhaust valve 30 abuts.

In an inner circumferential surface of the intake valve seat 26, an intake valve seat surface 261 is formed, on which the head 22 of the intake valve 20 abuts. In an inner circumferential surface of the exhaust valve seat 36, an exhaust valve seat surface 361 is formed, on which the head 32 of the exhaust valve 30 abuts.

The intake valve seat 26 is a seat formed in the intake connecting part 25 by cladding. For example, copper-based alloy powder, which is an example of metal powder, is fed to the intake connecting part 25 while irradiating the intake connecting part 25 with a laser beam. Then, the copper-based alloy powder is melted and adhered to the intake connecting part 25. By processing a part of the intake connecting part 25 where the copper-based alloy powder is adhered as stated above, the intake valve seat 26 is formed. A manufacturing method for a valve seat using a laser beam as stated above is called laser cladding, and a valve seat formed by laser cladding is sometimes referred to as a laser-cladded valve seat. The laser cladding is an example of a method for forming a valve seat.

Meanwhile, the exhaust valve seat 36 is formed such that the following two conditions are satisfied. The first condition is that heat conductivity of the exhaust valve seat 36 is lower than heat conductivity of the intake valve seat 26. The second condition is that heat capacity of the exhaust valve seat 36 is larger than heat capacity of the intake valve seat 26.

In the internal combustion engine 11 according to this embodiment, it is possible to employ a ring seat that is formed by sintering a metal-based material such as an iron-based material. A valve seat formed by sintering as stated above is structured with a number of micropores. Therefore, heat conductivity of the valve seat becomes lower than heat conductivity of a valve seat formed by cladding. Thus, the above-mentioned ring seat satisfies the first condition and the second condition.

Also, the exhaust valve seat 36 is structured so that a width of the exhaust valve seat 36 in a radial direction becomes larger than a width of the intake valve seat 26 in a radial direction. Further, the exhaust valve seat 36 is structured so that a length of the exhaust valve seat 36 in an axial direction becomes larger than a length of the intake valve seat 26 in an axial direction. Therefore, heat capacity of the exhaust valve seat 36 becomes larger than heat capacity of the intake valve seat 26.

The exhaust valve seat 36 is press-fitted into the exhaust connecting part 35 of the cylinder head 13. The intake valve seat 26 is integral with the cylinder head 13. On the contrary, the exhaust valve seat 36 is structured separately from the cylinder head 13. There are instances where a small space is present between the valve seat, which is press-fitted into the connecting part, and the cylinder head 13. This means that a degree of adhesion between the exhaust valve seat 36 and the cylinder head 13 is lower than a degree of adhesion between the intake valve seat 26 and the cylinder head 13. Therefore, heat transfer efficiency from the exhaust valve seat 36 to the cylinder head 13 is lower than heat transfer efficiency from the intake valve seat 26 to the cylinder head 13.

When press-fitting the exhaust valve seat 36 into the cylinder head 13, a load is applied to a periphery of the exhaust connecting part 35 in the cylinder head 13. At this time, when an interval between the exhaust connecting part 35 and the water jacket 19 is narrow, the shape of the water jacket 19 could be deformed excessively due to the load.

Therefore, in internal combustion engine 11 according to this embodiment, the shortest distance from the exhaust connecting part 35 to the water jacket 19 is set to be longer than the shortest distance from the intake connecting part 25 to the water jacket 19. By making the distance from the exhaust connecting part 35 to the water jacket 19 longer, rigidity of a part of the cylinder head 13 between the exhaust connecting part 35 and the water jacket 19 is enhanced. Thus, when press-fitting the exhaust valve seat 36 into the exhaust connecting part 35, tolerance against a load applied to the periphery of the exhaust connecting part 35 in the cylinder head 13 becomes high. Hence, excessive deformation of the part of the cylinder head 13 between the exhaust connecting part 35 and the water jacket 19 becomes unlikely.

The shortest distance from the exhaust valve seat surface 361 of the exhaust valve seat 36 to the water jacket 19 is regarded as "the first distance L1". The shortest distance from the intake valve seat surface 261 of the intake valve seat 26 to the water jacket 19 is regarded as "the second distance L2". By increasing the thickness of the part of the cylinder head 13 between the exhaust connecting part 35 and the water jacket 19, the second distance L2 becomes shorter than the first distance L1.

Next, an action of the internal combustion engine 11 according to this embodiment is explained. In a case where intake air is introduced into the combustion chamber 16 through the intake port 17, heat is exchanged between the intake valve 20, especially the head 22 of the intake valve 20, and the intake valve seat 26, and intake air. When temperature of the intake valve 20 and the intake valve seat 26 is higher than temperature of intake air, the intake air is warmed up by the intake valve 20 and the intake valve seat 26 and introduced into the combustion chamber 16. When exhaust gas generated inside the combustion chamber 16 is discharged into the exhaust port 18, heat of the exhaust gas is transferred to the exhaust valve 30 (especially the head 32 of the exhaust valve 30) and the exhaust valve seat 36. Therefore, temperature of the head 32 of the exhaust valve 30 and the exhaust valve seat 36 tends to be high. In particular, in the exhaust valve seat 36, temperature of the exhaust valve seat surface 361, which abuts on the head 32 of the exhaust valve 30, tends to be high.

In the internal combustion engine 11 according to this embodiment, a degree of adhesion between the exhaust valve seat 36 and the cylinder head 13 is lower than a degree of adhesion between the intake valve seat 26 and the cylinder head 13. Further, the exhaust valve seat 36 is structured so as to have lower heat conductivity than that of the intake valve seat 26. Therefore, heat is not easily transferred from the exhaust valve seat 36 to the cylinder head 13.

As a result, it becomes less likely that heat of exhaust gas transferred to the exhaust valve seat 36 is transferred to the periphery of the intake connecting part 25 in the cylinder head 13. In short, it is possible to restrain an increase in temperature of the periphery of the intake connecting part 25 in the cylinder head 13 due to heat of exhaust gas. Since it is less likely that temperature of the periphery of the intake connecting part 25 in the cylinder head 13 becomes high, it is also less likely that temperature of the intake valve seat 26 becomes high. As a result, heat transfer efficiency from the head 22 of the intake valve 20 to the cylinder head 13 through the intake valve seat 26 becomes high.

Heat transferred from the valve seat to the cylinder head 13 is recovered by cooling water flowing in the water jacket 19 that is positioned between the intake port 17 and the exhaust port 18. Therefore, the shorter the distance from the valve seat to the water jacket 19 becomes, the more efficiently the valve seat and the head of the valve are cooled. On the other hand, the longer the distance from the valve seat to the water jacket 19 becomes, the less efficiently the valve seat and the head of the valve are cooled.

In this regard, in the internal combustion engine 11 according to this embodiment, the second distance L2 is shorter than the first distance L1. The second distance L2 is the shortest distance from the intake valve seat surface 261 of the intake valve seat 26 to the water jacket 19. The first distance L1 is the shortest distance from the exhaust valve seat surface 361 of the exhaust valve seat 36 to the water jacket 19. Therefore, cooling efficiency of the intake valve seat 26 and the intake valve 20 by cooling water flowing inside the water jacket 19 becomes high. Thus, even when heat of exhaust gas is transferred to the periphery of the intake connecting part 25 in the cylinder head 13, cooling water flowing in the water jacket 19 is able to recover heat of the exhaust gas. As a result, an increase in temperature of the intake valve seat 26 and the head 22 of the intake valve 20 is restrained.

Accordingly, an increase in temperature of intake air introduced into the combustion chamber 16 through the intake port 17 is restrained, thereby restraining a reduction in a charging efficiency of intake air into the combustion chamber 16. When the internal combustion engine 11 is operated at high rotation and high-speed load, temperature of exhaust gas becomes extremely high. Even when the internal combustion engine 11 is operated at high rotation and high-speed load temporarily and temperature of exhaust gas thus increases temporarily; it is possible to reduce a heat transfer quantity from the exhaust valve seat 36 to the cylinder head because of the large heat capacity of the exhaust valve seat 36. In other words, heat received by the exhaust valve seat 36 from exhaust gas is transferred to the cylinder head 13 little by little. As a result, heat caused by a temporary temperature rise of exhaust gas is not easily transferred to the periphery of the intake connecting part 25 in the cylinder head 13. Therefore, a deterioration of heat transfer efficiency from the intake valve seat 26 to the cylinder head 13, caused by a temporary temperature rise of exhaust gas, is restrained. Then, a reduction in a charging efficiency of intake air into the combustion chamber 16 is restrained.

According to the foregoing structure and action, the following effects are obtained. First of all, in the internal combustion engine 11 according to this embodiment, since the second distance L2 is shorter than the first distance L1, cooling efficiency of the intake valve seat 26 and the intake valve 20 by cooling water flowing in the water jacket 19 is improved. Therefore, even when heat transferred from the exhaust valve seat 36 to the cylinder head 13 is transferred to the periphery of the intake connecting part 25 in the cylinder head 13, cooling water flowing in the water jacket 19 is able to efficiently recover heat in the periphery of the intake connecting part 25. As a result, a temperature rise of the intake valve seat 26 and the head 22 of the intake valve 20 is restrained. Thus, by restraining a temperature rise of the intake valve seat 26 and the head 22 of the intake valve 20, it is possible to restrain a reduction in a charging efficiency of intake air into the combustion chamber 16.

Secondly, the intake valve seat 26 is a seat formed by cladding on the intake connecting part 25, whereas the exhaust valve seat 36 is a seat that is press-fitted into the exhaust connecting part 35. Therefore, compared to a case where a press-fitted type valve seat is arranged in both the intake connecting part 25 and the exhaust connecting part 35, it is possible to make an interval between the intake connecting part 25 and the water jacket 19 narrower. As a result, it is possible to place the intake valve seat surface 261 of the intake valve seat 26 closer to the water jacket 19. In other words, it is possible to make it easy to realize a structure in which the second distance L2 is shorter than the first distance L1.

Thirdly, the intake valve seat 26 is a seat that is formed by cladding on the intake connecting part 25. Also, the exhaust valve seat 36 is a seat that is press-fitted into the exhaust connecting part 35. Therefore, a degree of adhesion between the exhaust valve seat 36 and the cylinder head 13 becomes lower than a degree of adhesion between the intake valve seat 26 and the cylinder head 13. Hence, heat transfer efficiency from the exhaust valve seat 36 to the cylinder head 13 is lower than heat transfer efficiency from the intake valve seat 26 to the cylinder head 13. As a result, heat is not easily transferred from the exhaust valve seat 36 to the cylinder head 13, and heat of exhaust gas is not easily transferred to the periphery of the intake connecting part 25 in the cylinder head 13. Thus, it becomes less likely that temperature of the periphery of the intake connecting part 25 in the cylinder head 13 becomes high. It is thus possible to restrain deterioration of heat transfer efficiency from the intake valve seat 26 to the cylinder head 13.

Fourthly, heat conductivity of the exhaust valve seat 36 is set to be lower than heat conductivity of the intake valve seat 26. Therefore, heat transfer efficiency from the exhaust valve seat 36 to the cylinder head 13 becomes even lower, thereby further improving cooling efficiency of the intake valve seat 26 and the head 22 of the intake valve 20.

Fifthly, heat capacity of the exhaust valve seat 36 is set to be larger than heat capacity of the intake valve seat 26. Therefore, even when the internal combustion engine 11 is operated at high rotation and high-speed load temporarily, and temperature of exhaust gas is increased temporarily, it is possible to restrain deterioration of heat transfer efficiency from the intake valve seat 26 to the cylinder head 13.

The foregoing embodiment may be changed to other embodiments stated below. Unless the exhaust valve seat 36 is broken when press-fitted to the exhaust connecting part 35, it is possible to use a valve seat in a size similar to that of the intake valve seat 26, as the exhaust valve seat 36.

As long as press-fitting to the exhaust connecting part 35 is possible, it is possible to use a ring seat other than the ring seat formed by sintering, as the exhaust valve seat 36. The intake valve seat 26 may be formed by other method than laser cladding as long as the intake valve seat 26 is formed by cladding on the intake connecting part 25.

As long as it is possible to make the second distance L2 shorter than the first distance L1, the exhaust valve seat 36 may be a seat formed by cladding on the exhaust connecting part 35 like the intake valve seat 26.

As long as it is possible to make the second distance L2 shorter than the first distance L1, the intake valve seat 26 may be a seat that is press-fitted to the intake connecting part 25, like the exhaust valve seat 36.

What is claimed is:

1. An internal combustion engine comprising:

a cylinder head including an intake port including an intake connecting part, the intake connecting part being a part at which the intake port and a combustion chamber of the internal combustion engine are connected with each other, a laser cladded valve seat which is provided at the intake connection part, the laser cladded valve seat being formed by cladding, an exhaust port including an exhaust connecting part, the exhaust connecting part being a part at which the exhaust port and the combustion chamber are connected with each other, a water jacket positioned between the intake port and the exhaust port in the cylinder head, a sintered ring seat which is press-fitted into the exhaust connecting part, an intake valve including an intake valve head, and an exhaust valve including an exhaust valve head, wherein the intake valve head contacts an intake valve seat surface of the laser cladded valve seat, the exhaust valve head contacts an exhaust valve seat surface of the sintered ring seat, and a first distance is a shortest distance between the water jacket and the exhaust valve seat surface, a second distance is a shortest distance between the water jacket and the intake valve seat surface, and the second distance is shorter than the first distance.

2. The internal combustion engine according to claim 1, wherein heat conductivity of the sintered ring seat is lower than heat conductivity of the laser cladded valve seat.

3. The internal combustion engine according to claim 1, wherein heat capacity of the sintered ring seat is larger than heat capacity of the laser cladded valve seat.

4. The cylinder head according to claim 1, wherein the laser cladded valve seat is formed from a copper based alloy powder and the sintered ring seat is formed from an iron based material.

5. A cylinder head, comprising:

an intake port including an intake connecting part, the intake connecting part being a part at which the intake port and a combustion chamber of the internal combustion engine are connected with each other;

an exhaust port including an exhaust connecting part, the exhaust connecting part being a part at which the exhaust port and the combustion chamber are connected with each other;

a water jacket positioned between the intake port and the exhaust port;

an intake valve including an intake valve head;

an exhaust valve including an exhaust valve head;

a laser cladded valve seat which is provided at the intake connection part, the laser cladded valve seat being formed by cladding; and a sintered ring seat which is press-fitted into the exhaust connecting part, wherein the intake valve head contacts an intake valve seat surface of the laser cladded valve seat, the exhaust valve head contacts an exhaust valve seat surface of the sintered ring seat, and a first distance is a shortest distance between the water jacket and the exhaust valve seat surface, a second distance is a shortest distance between the water jacket and the intake valve seat surface, and the second distance is shorter than the first distance.

6. The cylinder head according to claim 5, wherein:

heat conductivity of the sintered ring seat is lower than heat conductivity of the laser cladded valve seat.

7. The cylinder head according to claim 5, wherein heat capacity of the sintered ring seat is larger than heat capacity of the laser cladded valve seat.

* * * * *